US008736354B2

(12) United States Patent
Ivanov et al.

(10) Patent No.: US 8,736,354 B2
(45) Date of Patent: May 27, 2014

(54) ELECTRONIC DEVICE AND METHOD PROVIDING A VOLTAGE REFERENCE

(75) Inventors: Vadim V. Ivanov, Denton, TX (US); Johannes Gerber, Unterschleissheim (DE); Ralf Brederlow, Poing (DE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 12/955,046

(22) Filed: Nov. 29, 2010

(65) Prior Publication Data

US 2013/0293289 A1 Nov. 7, 2013

(51) Int. Cl.
*G05F 1/10* (2006.01)

(52) U.S. Cl.
USPC ..... 327/539

(58) Field of Classification Search
USPC ..... 323/313, 314; 327/513, 539
See application file for complete search history.

(56) References Cited

U.S. PATENT DOCUMENTS

| | | | | |
|---|---|---|---|---|
| 5,867,012 | A * | 2/1999 | Tuthill | 323/313 |
| 5,945,871 | A * | 8/1999 | Kausel et al. | 327/538 |
| 6,060,874 | A * | 5/2000 | Doorenbos | 323/316 |
| 6,819,163 | B1 * | 11/2004 | Gregoire, Jr. | 327/536 |
| 7,236,047 | B2 * | 6/2007 | Tachibana et al. | 327/539 |
| 7,429,129 | B2 * | 9/2008 | St. Pierre et al. | 374/178 |
| 7,786,792 | B1 * | 8/2010 | Gay | 327/539 |

* cited by examiner

*Primary Examiner* — Jeffrey Zweizig
(74) *Attorney, Agent, or Firm* — Robert D. Marshall, Jr.; W. James Brady; Frederick J. Telecky, Jr.

(57) ABSTRACT

An electronic device includes a bandgap reference voltage generation stage. The bandgap reference voltage generation stage comprises a device with a PN-junction, a current source feeding a first current during a first period of time and a second higher current during a second period of time through the PN-junction. The bandgap reference voltage is generated from a combination of a first voltage drop across the PN-junction during the first period of time and a second voltage drop across the PN-junction during the second period of time. This bandgap reference voltage is formed using switched capacitors.

7 Claims, 2 Drawing Sheets

ELECTRONIC DEVICE AND METHOD PROVIDING A VOLTAGE REFERENCE

CLAIM OF PRIORITY

This application claims priority under 35 U.S.C. 119(a) to German Patent Application No. 10 2009 065 595.1 filed Dec. 2, 2009.

TECHNICAL FIELD OF THE INVENTION

The technical field of this invention is an electronic device and a method for providing a voltage reference and more specifically for providing a reversed bandgap voltage reference.

BACKGROUND OF THE INVENTION

It is well known in the art that a first order temperature independent bandgap reference voltage VBGAP can be described as:

$$VBGAP = VBE1 + KD \times Vt \ln\left(\frac{IC1 \times IS2}{IS1 \times IC2}\right) \tag{1}$$

where: VBE1 is the base emitter voltage of a first bipolar transistor; IC1 is the collector current of the first bipolar transistor; IS1 is the saturation current of the first bipolar transistor; IC2 is the collector current of a second bipolar transistor; and IS2 the saturation current of the second bipolar transistor. Furthermore, IC1 is greater than IC2 because the current or the current density of the first bipolar transistor has to be greater than that of the second bipolar transistor. VT is the temperature voltage; KD is a design parameter greater than 1; and n is the ratio between IC1 and IC2. IS1 and IS2 are usually equal. Equation (1) can also be written as:

$$VBGAP = VBE1 + KD(VBE1 - VBE2) \tag{2}$$

where: VBE2 is the base emitter voltage of the second bipolar transistor. The bandgap voltage VBGAP is a technology dependent constant and about 1.2 V.

Equation (2) may be divided by KD and re-arranged as:

$$VRBGP = \frac{VBGAP}{KD} = \frac{1}{KD}VBE1 + (VBE1 - VBE2) = VBE1\left(1 + \frac{1}{KD}\right) - VBE2 \tag{3}$$

The bandgap voltage VBGAP is then scaled down by the factor KD. This can provide a reversed bandgap voltage level VRBGP of about 200 mV.

Equation (3) may also be written as:

$$VRBGP = \frac{1}{KD}VBE1 + Vt \ln\left(\frac{IC1 \times IS2}{IS1 \times IC2}\right) \tag{4}$$

U.S. Pat. No. 7,411,443 discloses a high precision reversed bandgap voltage reference circuit. FIG. 1 illustrates an embodiment of this kind of reversed bandgap voltage reference circuit. First resistor R1 and second resistor R2 are coupled as a voltage divider which is connected between ground and first conductor 17. The circuit includes first transistor Q1 and second transistor Q2. The base of first transistor Q1 is coupled to the voltage divider to produce a first voltage VBE1(1+1/KD) between first conductor 17 and ground at node 16A. KD is the ratio of the resistances of first resistor R1 and second resistor R2. Second transistor Q2 is also coupled through respective resistors R4 and R5 between first conductor 17 and ground. The base of second transistor Q2 is coupled to first conductor 17. The circuit includes amplifier 12. The positive input of amplifier 12 is coupled to the collector of first transistor Q1 (node 16A) and the negative input of amplifier 12 is coupled to the collector of second transistor Q2 (node 16B). The output of amplifier 12 is coupled to a gate of MOSFET M1. MOSFET M1 is coupled between the supply voltage VDD and first conductor 17. Amplifier 12 controls conduction in MOSFET M1 so that the voltages on nodes 16A and 16B are equal. The reversed bandgap voltage VRBGP is output at the emitter of second transistor Q2. Due to the coupling of the transistors Q1 and Q2, the voltage at first conductor is VBE1(1+1/KD)=VBE2+VRBGP. This provides that VRBGP=VBE1(1−1/KD)−VBE2 as shown by Equation (3).

The circuits described in U.S. Pat. No. 7,411,443 provide exceptional accuracy and they are capable of operating with supply voltage levels below 1 V. However, these circuits are rather complex and they require bipolar transistors with a high gain of at least 40. The collectors of these transistors cannot be mandatorily tied to ground because of their substrate type as some technologies require. In particular, standard CMOS technologies provide only low gain of 3 to 4 and substrate type bipolar transistors.

SUMMARY OF THE INVENTION

It is an object of the invention to provide an electronic device and a method for providing a reference voltage for technologies with low gain bipolar transistors which is less complex and more robust than prior art concepts.

In one aspect of the invention, an electronic device includes a bandgap reference voltage generation stage having a device with a PN-junction. The device can be a transistor preferably a bipolar transistor. A current source selectively feeds a current of a first magnitude during a first period of time and a current of a second magnitude during a second period of time through the PN-junction. An output stage provides a voltage which is a combination of a first voltage drop across the PN-junction during the first period of time and a second voltage drop across the PN-junction during the second period of time. The combination of the voltage drops across the PN-junction during different time periods is preferably the sum of a fraction of the first voltage drop across the PN-junction and the difference of the first voltage drop across the PN-junction and a second voltage drop across the PN-junction. This changes the basic structure of a bandgap reference voltage generator. It is still possible to achieve a temperature compensated reversed bandgap voltage. Instead of two devices such as first and second transistors, the invention requires only a single device with a PN-junction such as a single transistor. The single PN-junction is fed with two different magnitudes of current during two different periods of time. The second current is advantageously selected to generate a voltage drop across the PN-junction that corresponds to the second voltage drop across the PN-junction. A sum of the consecutive voltage drops provides a reversed bandgap voltage as indicated by equation (4). This shifts some aspects of the bandgap principle from hardware to the time domain. These aspects and the other aspects of the invention are applicable using PNP and NPN bipolar transistors. Thus a single PN-junction is sufficient.

In an embodiment, the output stage includes a capacitive voltage divider providing a fraction of the first voltage drop. The capacitive voltage divider is then coupled to raise the fraction of the first voltage drop by a difference of the first voltage drop and a second voltage drop across the PN-junction during the second period of time. This is achieved by leaving a side of the capacitive voltage divider floating during the second period of time. The voltage levels on the capacitive divider are then basically frozen. The capacitive voltage divider is then coupled with the side that is not floating to the PN-junction. If the second side is left floating and the voltage drop on the PN-junction is changed while the other side is coupled to the PN-junction, the voltage levels on the nodes of the capacitive voltage divider change by the change of the voltage level on the PN-junction. Therefore if the voltage drop across the PN-junction changes from a first voltage drop to a second voltage drop due to different currents through the PN-junction, the voltage levels on the floating capacitance or capacitive divider are raised by the difference of the first and the second voltage drop. The capacitive divider includes at least a first and a second capacitor coupled in series. The first capacitor is coupled to the PN-junction and the second capacitor is floating during the second period of time. After the first period of time, the node between the first and second capacitor has a voltage level corresponding to a fraction of the first voltage drop across the PN-junction. Between the first and the second period of time, the other side of the second capacitor is switched from a supply voltage level or reference voltage level to float during the second period of time. Thus the capacitive voltage divider is charged to a total voltage drop equal to the first voltage drop which is produced across the PN-junction during the first period of time. During the second period of time, the capacitive divider is decoupled at one side to be floating. The other side receives the voltage drop which is produced across the PN-junction during the second period of time.

The fraction of the first voltage drop and the ratio of the first and the second magnitude of the current provide respective negative and positive voltage temperature dependency which compensate each other. The fraction of the first voltage drop and the ratio of the first and the second magnitude of the currents through the PN-junctions during respective first and second periods of time provide temperature dependencies which compensate each other with respect to the combined output voltage. The output stage samples the combined voltage to serve as a temperature compensated reversed bandgap voltage reference.

The electronic device is further configured to sample and hold the voltage at a node of the capacitive voltage divider during the second period of time. The ratio of the currents during the first and the second period of time is chosen generating a voltage change that corresponds to a difference of the first voltage drop and a second voltage drop across the PN-junction. The capacitive divider then provides the sum of the fraction of the first voltage drop and the difference of the first voltage drop and the second voltage drop. This means that the voltage level on a node of the capacitive divider during the second period of time is the reversed bandgap reference voltage level.

In another aspect of the invention, the output stage includes an amplifier. The amplifier has a gain stage amplifying the voltage from the capacitive voltage divider. The amplifier is coupled to the capacitive voltage divider to provide a buffered and/or amplified output voltage which is proportional to the voltage level on the node of the capacitive voltage divider. This output voltage is provided during the second period of time.

The voltage follower preferably includes auto-zeroing. Auto-zeroing may advantageously be performed during the first period of time. A switch connects the output of the amplifier with its negative input during the first period of time. A capacitor is coupled to the inverted input of the amplifier. Two other switches connect the other side of the capacitor and the positive input of the amplifier to ground during the first period of time. This efficient auto-zeroing mechanism removes errors and offsets.

The invention also provides a method of generating a bandgap reference voltage. A current of a first magnitude is fed to a PN-junction during a first period of time. A current of a second magnitude is fed to the PN-junction during a second period of time. A voltage is thus provided that is a combination of a first voltage drop across the PN-junction during the first period of time and a second voltage drop across the PN-junction during the second period of time. The combination may be the sum of a fraction of the first voltage drop and the difference of the first voltage drop and a second voltage drop. This can be used to generate a reversed bandgap reference voltage. Accordingly, the relationship of the first and the second voltage drop in accordance with the respective currents is then determined in the time domain and the circuit can simplified. Furthermore, the PN-junction can be much simpler.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
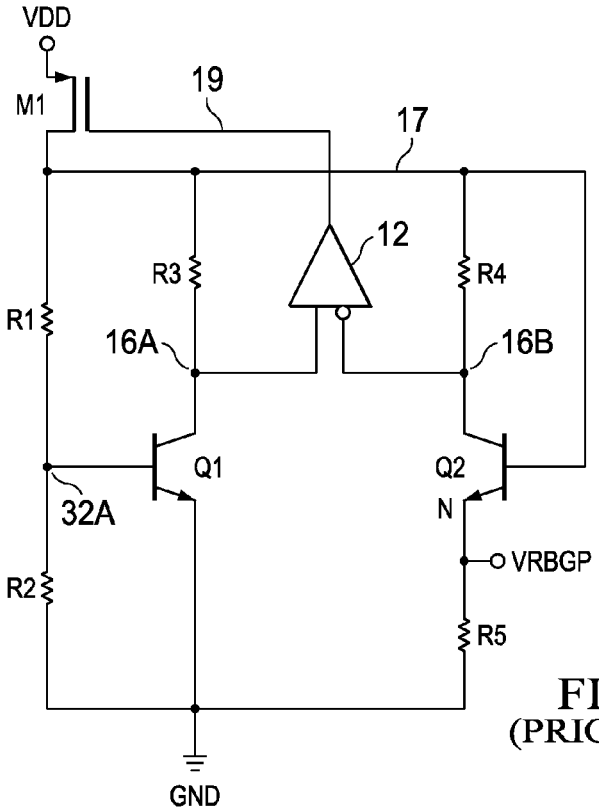
FIG. 1 (PRIOR ART)
FIG. 1 is a simplified circuit diagram of a reversed bandgap voltage reference generator according to the prior art.
Figure 2:
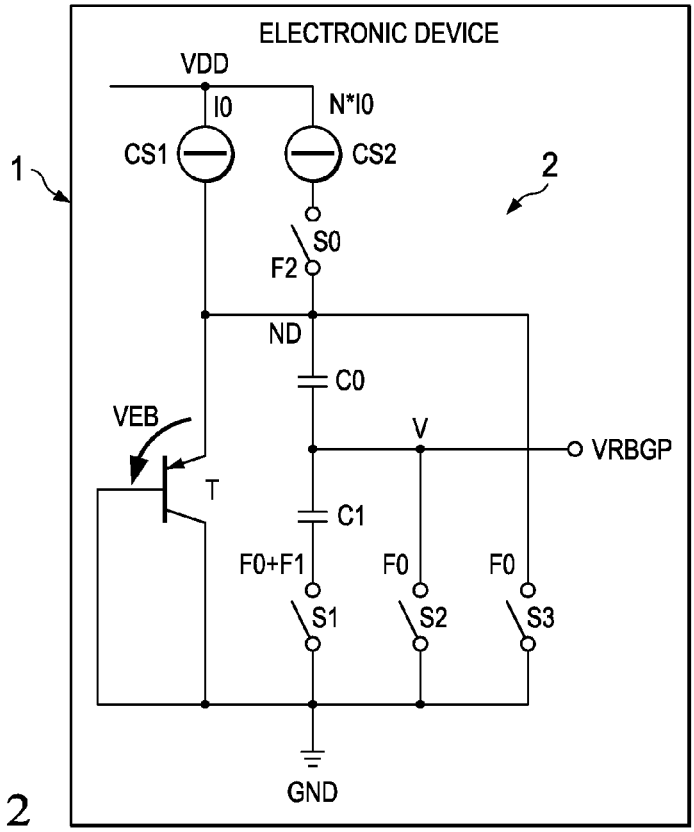
FIG. 2 is a simplified circuit diagram of a reversed bandgap voltage reference generator according to an embodiment to the invention.

FIG. 2 shows a simplified circuit diagram of electronic device 1 including reversed bandgap voltage reference generator 2 in accordance with aspects of this invention. The electronic device may be the electronic circuitry of an integrated semiconductor circuit. The electronic device is a data processing system or any other device including a reversed bandgap voltage reference generator 2 according to an embodiment of the invention. Reversed bandgap voltage reference generator 2 includes a PNP type bipolar transistor T. However, in another embodiment an NPN type may be used. The emitter base voltage is called VEB. For an NPN transistor, the base emitter voltage VBE would be equivalent. Although the description of this embodiment of the invention refers to PNP transistors and VEB voltages, the skilled artisan may equally apply the aspects of the invention to NPN transistors without departing from the invention.

The collector of transistor T is coupled to ground GND. Thus the invention can be applied to substrate type bipolar transistors. The base of transistor T is also coupled to ground GND. The emitter of transistor T is coupled to node ND. Two current sources CS1 and CS2 are coupled between supply voltage VDD and node ND. A switch S0 coupled between the output of the second current source CS2 and node ND may selectively connect or disconnect the second current source CS2 to or from node ND. A single variable current source may be used instead of two current sources CS1 and CS2 as long as this variable current source provides at least two currents of different magnitude to the emitter of transistor T. A current mirror may be used as either of the current sources CS1 or CS2. The first current source CS1 feeds a current I0 to the emitter of transistor T and through the PN-junction within transistor T. The current I0 establishes through transistor T a corresponding emitter base voltage VEB. If switch S0 is closed, the current from the second current source CS2 is also fed to node ND and therefore to the emitter of transistor T. This increases the current through the PN-junction within transistor T and the voltage drop between emitter and base of transistor T changes. The emitter collector current of transistor T has a first magnitude of I0 during a first period of time F1. The corresponding first voltage drop across the PN-junction within transistor T is referred to as VEBT1. The emitter collector current of transistor T has a second magnitude of N+1 times I0 during a second period of time F2. The voltage drop across the PN-junction (emitter base voltage) during the second period of time is called VEBT2.

A capacitive divider is coupled between node ND and ground GND. The capacitive divider includes two capacitors C0 and C1 coupled in series. Capacitor C0 is coupled with one side to node ND and with the other side to capacitor C1. Capacitor C1 is coupled with one side to capacitor C0 and with the other side to switch S1. Switch S1 is coupled with the other side to ground GND. Switch S2 is coupled between ground and the node VRBGP between C0 and C1. Switch S3 is coupled between node ND and ground. Reference signs F0, F1 and F2 refer to periods of time during which the respective switches are conducting. F0, F1 and F2 are advantageously periods of non-overlapping clock signals. The non-overlapping clock signals may be periodic and derived from a common periodic clock signal. Thus periods F0, F1 and F2 may have the same frequency. F0 is an initial phase. Switch S0 is conducting during second period of time F2. Switch S1 is conducting during first period of time F1. Switches S1, S2 and S3 are conducting during a third or an initial period of time F0.

During the first period of time F1 the base emitter voltage of transistor T is VEBT1. The voltage level on node ND is also VEBT1. The voltage across the capacitive divider C0/C1 is also VEBT1. During the second period of time F1, only switch S0 is conducting and a current N+1 times I0 is fed to transistor T. The capacitive divider C0/C1 is floating. The base emitter voltage of transistor T is then VEBT2. Node ND is raised by the voltage difference between VEBT2−VEBT1 during the second phase F2. The ratio of the magnitudes of the current through the PN-junction during the first and the second phases F1 and F2 provides that the difference of the second voltage drop VEBT2 and the first voltage drop VEBT1 raises the voltages levels on the floating voltage divider. During the second phase F2, switches S1, S2 and S3 are disconnected. The side of capacitive voltage divider C0/C1 opposite to node ND is floating. The voltage level on node ND rises by VEBT2−VEBT1, but the fractions of the previous base emitter voltage VEBT1 are preserved on the respective capacitors C0 and C1. Therefore the following reversed bandgap voltage VRBGP is generated during the second period of time F2:

$$VRBGP = VEBT1\left(\frac{C0}{C0+C1}\right) + (VEBT1 - VEBT1) = VEBT1\left(\frac{C0}{C0+C1}\right) + VT\ \ln\ (N+1) \tag{5}$$

If this is compared with equation (4), it is apparent that the factor KD of equation (4) can be adjusted through capacitors C0 and C1 as:

$$KD=(C0+C1)/C0 \tag{6}$$

The parameter N can be adjusted through the ratio of currents IC1 and IC2. In this embodiment IC1=10 and IC2=(N+1)I0. IS1 and IS2 of equation (4) are inherently equal.

This can also be explained with respect to the three time periods F0, F1 and F2. During the third or initial period of time F0, switches S1, S2 and S3 are closed (connecting). Phase F0 serves as a preparation phase, during which the capacitive divider is brought into a defined initial state. During first period of time F1, VEBT1 is sampled on the capacitive voltage divider and S1 is closed (connecting) and S0, S2 and S3 are open (disconnected). At the beginning of the second period of time F2, the capacitive voltage divider is decoupled and therefore floating. The voltage on node ND rises to VEBT2 and therefore the frozen voltage levels on the floating capacitive voltage divider C1/C2 rise by VEBT2−VEBT1 (VEBT2>VEBT1). Finally, the voltage on node VRBGP can be sampled via a circuit shown in FIG. 3. Switch S0 is closed (connecting) and switches S1, S2 and S3 are open (disconnected). The sampled voltage is then the reverse bandgap voltage, which is a result of the three steps.

N may be chosen greater than 1. N may for example be 10, 20 or 50 or greater. Practical values for N may be powers of two minus one, as for example 7, 15, 31, 63, 127 etc. In one embodiment, C0 and C1 have a ratio between 6 and 7. C0 may be 0.56 pF and C1 may be 3.66 pF. The division factor KD of the capacitive divider may then be about KD≈4.22/0.56≈7.54. This means about 13.3% of VEB at current level I0 are generated at circuit node VRBGP in the first phase F1. The current ratio in this design can be 1:64 making N=63. Equation (5) yields VRBGP as follows:

$$\begin{aligned} VRBGP &= VEBT1 \times \frac{1}{KD} + VT\ \ln\ (N+1) \\ &\approx 0.133 \times 530\ \text{mW} + 26\ \text{mV} \times \ln(64) \\ &\approx 180\ \text{mV} \end{aligned} \tag{7}$$

where: VT=kT/q≈26 mV at a temperature of 25° C.; and k is the Boltzmann constant. The magnitude of VRBGP can be adjusted using an amplifier stage to any target value. The parameters KD can be selected by capacitor ratio C1/C0 and N can be selected by the ratio of the magnitudes of the currents so that the negative temperature slope of VEB=−2 mV/K and the positive temperature slope of the term VT ln(N+1) compensate each other. This provides a temperature stable reference voltage.

Figure 3:
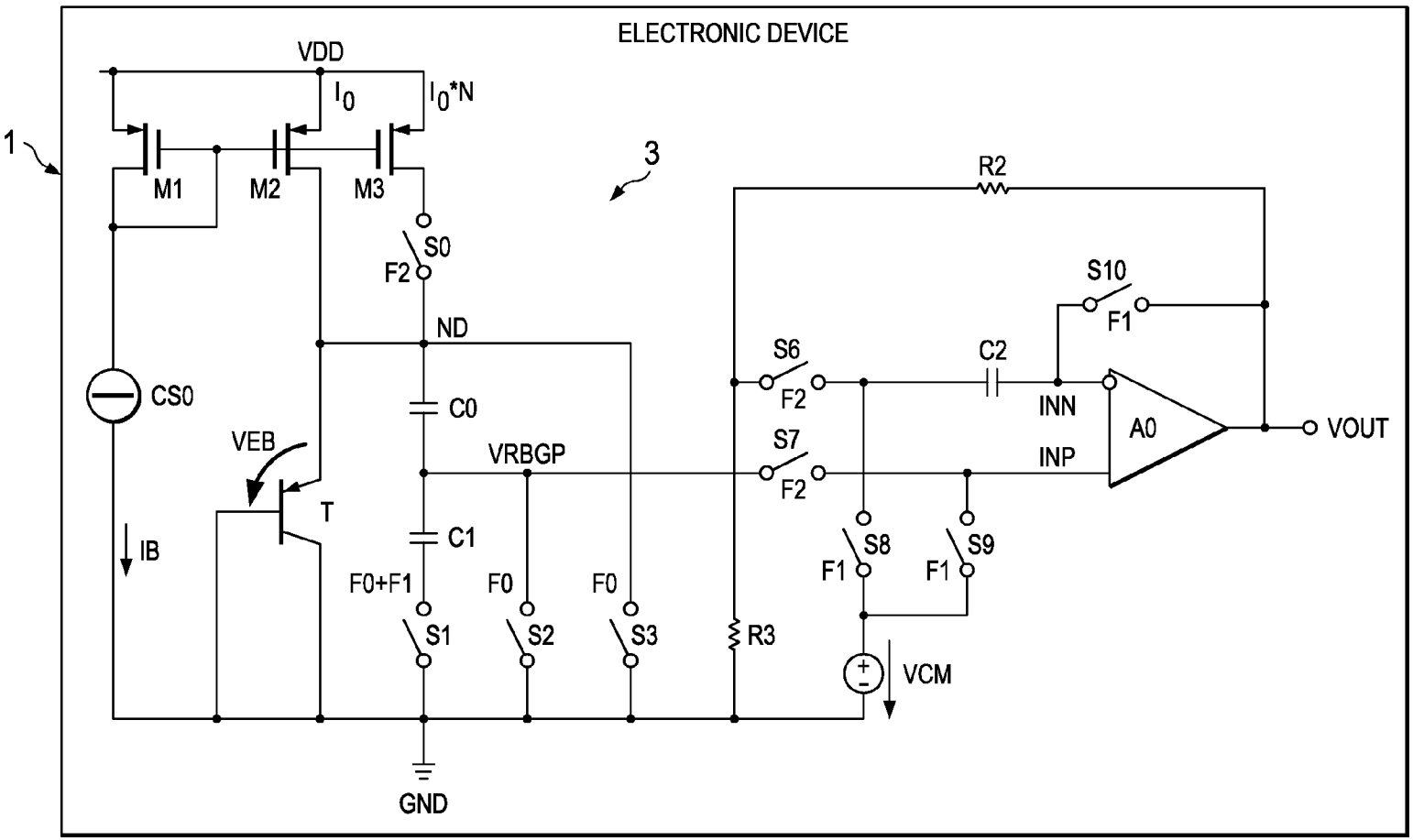
FIG. 3 is a simplified circuit diagram of a reversed bandgap voltage reference generator with auto-zeroing sampling stage.

FIG. 3 shows a simplified circuit diagram of an electronic device according to another embodiment of the invention including alternative reversed bandgap voltage reference generator 3. The left side of reversed bandgap voltage reference generator 3 is substantially similar to reversed bandgap reference voltage generation stage 2 illustrated in FIG. 2. However, the current sources CS1 and CS2 of FIG. 2 are now replaced by a current mirror configuration. This current mirror configuration includes a current source CS0 supplying a reference current IB which is then mirrored and multiplied by a current mirror including transistors M1, M2 and M3. Transistor M2 provides a current of a first magnitude I0. Transistor M3 is dimensioned so as to provide a current of a second magnitude N times I0 in this embodiment. N may be much greater than 1 such as 10, 20, 50 or greater. N may be one less than an integral power of 2 such as 7, 15, 31 or 63. The circuit operates similarly to the one shown in FIG. 2.

Reversed bandgap voltage reference generator 3 includes amplifier A0 for buffering and amplifying the reversed bandgap reference voltage VRBGP available during phase F2. Amplifier A0 is preferably an operational amplifier coupled as a gain stage. Resistor R2 is coupled between the output and one side of capacitor C2 which is coupled at its other side to the negative input of amplifier A0. C2 relates to an auto-zero mechanism which will be explained in more detail below. Resistor R3 is coupled between ground GND and the side of resister R2 connected to C2. In the absence of capacitor C2 this is the negative input INN of amplifier A0. The gain of the stage can be set by the ratio of resistors R2 and R3. The gain may be 1 making such an amplifier operate as a voltage follower.

The feedback connection between output VOUT of amplifier A0 and negative input INN is closed by switch S10 during the first period of time F1. Phase F1 is an optional auto-zeroing phase used if amplifier A0 has an auto-zeroing mechanism. During the second period of time F2 amplifier A0 operates as a gain stage. Capacitor C2 is coupled through switch S6 to the common node between R2 and R3 and negative input INN of amplifier A0. Capacitor C2, switches S6, S7, S8, S9, S10 and common mode voltage source VCM auto-zero amplifier A0 operating as a voltage follower. Switch S7 selectively couples and decouples node VRBGP (the reversed bandgap reference voltage level) to and from positive input INP of amplifier A0. Switch S8 is coupled between the node between switch S6 and capacitor C2 and the positive terminal of common mode voltage source VCM. Switch S9 is coupled between positive input INP of amplifier A0 and the positive terminal of common mode voltage source VCM. Switches S10, S8 and S9 are closed (connecting) during the first period of time F1. Switches S6 and S7 are closed (connecting) during the second period of time F2. This coupled both inputs INN and INP of amplifier A0 to the same common voltage level (the optimum common mode voltage level) during the first period of time F1. Any inherent offset voltage present at VOUT during the first period of time F1 is preserved on C2. Switches S8, S9 and S10 are open (disconnected) during the second period of time F2, but the voltage across C2 is preserved and compensates the inherent offset of amplifier A0. During the second period of time F2, the reversed bandgap reference voltage VRBGP from the reference voltage generator is supplied to positive input INP of amplifier A0 through switch S7. Switch S10 is open (disconnected) and resistors R2 and R3 configure amplifier A0 as a non-inverting gain stage with an amplification factor of (R2+R3)/R3 meaning that VOUT=(VRBGP(R2+R3))/R3. Output voltage VOUT is sampled on a capacitor.

Although the invention has been described hereinabove with reference to specific embodiments, it is not limited to these embodiments and no doubt further alternatives will occur to the skilled person that lie within the scope of the invention as claimed.

What is claimed is:

1. An electronic device having a bandgap reference voltage generation stage comprising:

a device with a PN-junction;

a current source operable to supply a current of a first magnitude during a first period of time and a current of a second magnitude during a second period of time through the PN-junction; and an output stage generating a voltage as the bandgap reference voltage from a combination of a first voltage drop across the PN-junction during the first period of time and a second voltage drop across the PN-junction during the second period of time, the output stage including a capacitor voltage divider having a first capacitor having a first terminal connected to a first terminal of the PN-junction and second terminal, a second capacitor having a first terminal connected to the second terminal of the first capacitor and a second terminal, and a first switch having a first terminal connected to the second terminal of the second capacitor and a second terminal connected to a second terminal of the PN-junction, the first switch controlled to conduct during the first period of time and not conduct during the second period of time.

2. The electronic device of claim 1, wherein:

the second terminal of the PN-junction and the second terminal of the first switch are connected to ground;

the output stage is further includes a second switch having a first terminal connected to the second terminal of the first capacitor and a second terminal connected to ground, the second switch controlled to conduct only during an initialization period before the first period of time, a third switch having a first terminal connected to the first terminal of the first capacitor and a second terminal connected to ground, the third switch controlled to conduct only during the initialization period; and the output stage wherein the first switch is controlled to conduct both during the initialization period and the first period of time.

3. The electronic device according to claim 1, wherein:

the output stage further includes an amplifier having an inverting input terminal, a non-inverting input terminal and an output, a first resistor having a first terminal connected to the output of the amplifier and a second terminal, a second resistor having a first terminal connected to the second terminal of the first resistor and a second terminal connected to ground, a fourth switch having a first terminal connected to the second terminal of the first resistor and a second terminal, the fourth switch controlled to conduct during the second period of time and not conduct during the first period of time, a third capacitor having a first terminal connected to the second terminal of the fourth switch and a second terminal connected to the inverting input terminal of the amplifier, and a fifth switch having a first terminal connected the first terminal of the second capacitor and a second terminal connected to non-inverting input of the amplifier, the fifth switch controlled to conduct during the second period of time and not conduct during the first period of time.

4. The electronic device according to claim 3, wherein:

the output stage further includes a sixth switch having a first terminal connected to the inverting input of the amplifier and a second terminal connected to the output of the amplifier, the sixth switch controlled to conduct during the first period of time, a current source having a first terminal and a second terminal connected to ground, a seventh switch having a first terminal connected to the second terminal of the fourth switch and a second terminal connected to the first terminal of the current source, the seventh switch controlled to conduct during the first period of time, an eighth switch having a first terminal connected to the second terminal of the fifth switch and a second terminal connected to the first terminal of the current source, the eighth switch controlled to conduct during the first period of time.

5. A method of generating a bandgap reference voltage, the method comprising the steps of:

feeding a current of a first magnitude to a PN-junction during a first period of time;

feeding a current of a second magnitude to the PN-junction during a second period of time; and forming a voltage output for use as a bandgap reference voltage from a combination of a first voltage drop across the PN-junction caused by the first current during the first period of time and a second voltage drop across the PN-junction caused by the second current during the second period of time, the step of forming a voltage output for use as a bandgap reference voltage including:

charging a capacitor divider formed of a series connection of a first capacitor and a second capacitor with the first voltage drop across the PN-junction caused by the first current during the first period of time, charging the second capacitor with the second voltage drop across the PN-junction caused by the second current during the second period of time while isolating the first capacitor, and sensing a voltage at a node in the series connection of the first capacitor and the second capacitors during the second period of time.

6. The method of claim 5, wherein:

the step of forming a voltage output for use as a bandgap reference voltage includes discharging any charge stored on the first capacitor and on the second capacitor during an initialization period before the first period of time.

7. The method of claim 6, wherein:

the step of forming a voltage output for use as a bandgap reference voltage includes sampling the voltage at the node in the series connection of the first capacitor and the second capacitors during the second period of time, and storing the sampled voltage on a third capacitor.

* * * * *